US005361734A

United States Patent [19]

Shirai

[11] Patent Number: 5,361,734

[45] Date of Patent: Nov. 8, 1994

[54] VALVE CONTROL DEVICE FOR AN ENGINE

[75] Inventor: Eiji Shirai, Nukata, Japan

[73] Assignee: Aisin Seiki Kabushiki Kaisha, Kariya, Japan

[21] Appl. No.: 121,565

[22] Filed: Sep. 16, 1993

[30] Foreign Application Priority Data

Sep. 18, 1992 [JP] Japan ..... 4-249322

[51] Int. Cl.[5] ..... F01L 1/34; F02D 13/06

[52] U.S. Cl. ..... 123/90.16; 123/198 F

[58] Field of Search ..... 123/90.15, 90.16, 90.48, 123/198 F

[56] References Cited

U.S. PATENT DOCUMENTS

| | | | |
|---|---|---|---|
| 4,667,636 | 5/1987 | Oishi et al. | 123/90.16 |
| 4,770,137 | 9/1988 | Okabe et al. | 123/198 F |
| 5,163,389 | 11/1992 | Fujikawa et al. | 123/90.16 |
| 5,247,913 | 9/1993 | Manolis | 123/90.16 |

*Primary Examiner*—E. Rollins Cross
*Assistant Examiner*—Weilun Lo
*Attorney, Agent, or Firm*—Oblon, Spivak, McClelland, Maier, & Neustadt

[57] ABSTRACT

In a valve control device for an engine having a fuel supply means arranged in a suction passage, a valve arranged in an intake or exhaust passage, and a cam for driving the valve to open and close via a lifter, the lifter comprises a body which slides in a bore of a cylinder head of the engine, a cylinder arranged in the body and forming a sliding passage perpendicularly to an axial direction of the valve, a spool which is transferred between a first position and a second position in the sliding passage by hydraulic pressure, a slider arranged in the spool and having a driving force transmitting portion and a cavity portion, and a spring which holds the spool at the first position, and a stop valve is arranged between the fuel supply means and the valve in the suction passage in order to close the suction passage when the spool is at the first position. When the spool is held at the second position, the driving force of the cam is transmitted to the valve only via the body and the driving force transmitting portion of the slider, and never transmitted to the spool. Thus, a stabilized change-over operation of the valve control device is achieved.

1 Claim, 7 Drawing Sheets

VALVE CONTROL DEVICE FOR AN ENGINE

BACKGROUND OF THE INVENTION

1. Field of the Invention

The present invention relates to a valve control device fop an internal combustion engine.

2. Description of the Prior Art

For internal combustion engines, it is a well known technique to rest cylinders by stopping actuation of suction (intake) and exhaust valves and fuel supply, or to vary valve timing and valve strokes, in order to lower fuel consumption and enhance output. In general, suction and exhaust valves fop opening and closing suction and exhaust ports which ape provided in a combustion chamber of an engine are controlled to be opened and closed by a mechanism in which one end of a rocker arm swinging around a rocker shaft contacts a lope end of a valve stem of each valve, while the other end of the rocker arm is connected to a pushrod via an adjuster, and the pushrod is combined with a cam through a tappet, and often by a mechanism in which the other end of the rocker arm is combined with a cam, or a direct type mechanism in which the valve stem is in direct contact with the cam via a lifter. Thus, a lot of mechanisms for operating suction and exhaust valves have been proposed so far. Further, in order to rest cylinders by keeping suction and exhaust valves closed, improvements have been made to a lifter disposed between the aforementioned rocker arm or cam, and the fore end of the valve stem. An example of the improvements is disclosed in Japanese Examined Utility Model Publication No. 7526/1991.

In this publication, a plunger having an axis perpendicular to an axial direction of a valve stem is provided in a lifter. The plunger has a receiving surface which can contact a fore end portion of the valve stem, and an idle bore for receiving the fore end portion of the stem. When hydraulic pressure is applied on one end of the plunger, the plunger slidably moves in the lifter against the urging force of a spring provided at the other end of the plunger, thereby bringing the fore end portion of the valve stem which has been in contact with the receiving surface to enter the idle bore. When the fore end portion of the valve stem enters the idle bore, reciprocating motion caused by the cam is not transmitted to the valve stem, only to make the fore end portion of the valve stem go in and out of the idle bore of the plunger and leave the suction or exhaust valve closed. When hydraulic pressure which has been applied on the one end of the plunger is relieved and the lifter comes to the upper limit position (in this position, the fore end portion of the stem is out of the idle bore), the spring provided at the other end of the plunger urges the plunger to the initial position, i.e., the position at which the receiving surface of the plunger contacts the fore end portion of the valve stem, thereby allowing regular operations of the suction or exhaust valve.

In this publication, however, the receiving surface of the plunger in the lifter contacts the fore end portion of the valve stem by the force of the spring fixed on the valve stem. In this case, since the line of action of the spring force of the valve stem is perpendicular to the axial direction of the plunger, the plunger receives force to deviate the axis of the plunger, and moreover, transmits this force to the lifter via the outer circumferential surface of the plunger. Since the transmission of this force produces unbalanced wear on the receiving surface and the outer circumferential surface of the plunger and deviates the axis of the plunger, the plunger does not move smoothly, and the valve change-over operation offers a problem of reliability.

SUMMARY OF THE INVENTION

Therefore, it is an object of the present invention to stabilize the valve change-over performance of a valve control device for internal combustion engines.

The valve control device for an engine according to the present invention has a fuel supply means arranged in a suction passage, a valve arranged in a suction or exhaust passage, and a cam for driving the valve to open and close via a lifter, the lifter comprising a body which slidably moves in a bore formed in a cylinder head of the engine, a cylinder arranged in the body and forming a sliding passage in a direction perpendicular to an axial direction of the valve, a spool which is transferred between a first position and a second position in the sliding passage by hydraulic pressure, a slider arranged in the spool and having a driving force transmitting portion and a cavity portion, and a spring which holds the spool at the first position, the driving force of the cam being transmitted to the valve via the body and the driving force transmitting portion of the slider, and a stop valve being arranged between the fuel supply means and the valve in the suction passage in order to close the suction passage when the spool is held at the first position.

According to the present invention, when the engine is stopped, the spool is held at the first position by the spring, and after the engine is started, the spool is held at the first position or the second position by hydraulic pressure. When the spool is held at the first position, the valve stem overlaps with the cavity portion of the slider, and accordingly the reciprocating motion of the lifter caused by the cam is absorbed and the valve does not have an opening or closing operation. Simultaneously, the stop valve arranged between the fuel supply means and the valve in the suction passage closes the suction passage. On the other hand, when the spool is held at the second position, the valve stem contacts the driving force transmitting portion of the slider, and accordingly the driving force of the cam is transmitted to the valve only through the body and the driving force transmitting portion of the slider, and the driving force of the cam is never transmitted to the spool.

The valve control device for an engine according to the present invention has the following advantage. Namely, the driving force of the cam is transmitted to the valve only via the driving force transmitting portion of the slider, and the spool which moves the slider between the first position and the second does not influence the transmittance of the driving force. Therefore, no irregular force is applied on the spool in the sliding passage and no unbalanced wear generates. Thus, the stabilized change-over performance between the first position and the second position is secured.

BRIEF DESCRIPTION OF THE DRAWINGS

Other objects and features of the invention will become apparent to those skilled in the art as the disclosure is made in the following description of a preferred embodiment of the invention, as illustrated in the accompanying sheets of drawings, in which.

DETAILED DESCRIPTION OF THE PREFERRED EMBODIMENT

A preferred embodiment according to the present invention will be described with reference to the attached drawings.

Figure 2:
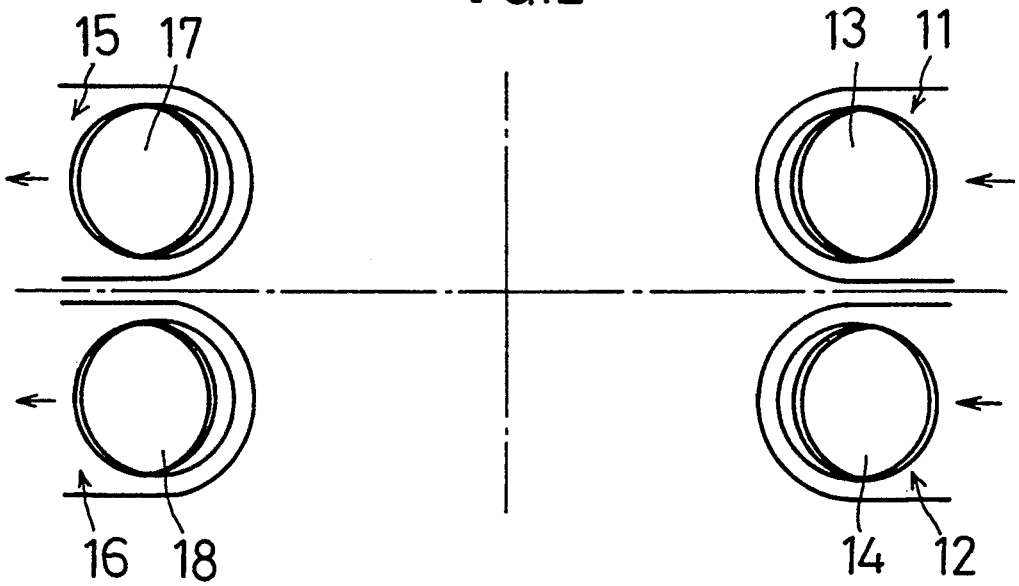
FIG. 2 is a diagrammic view of suction and exhaust valves according to the preferred embodiment of the present invention.

As shown in FIG. 2, a four-valve type engine generally has two suction (intake) passages 11, 12 and suction (intake) ports 13, 14, and two exhaust passages 15, 16, and exhaust ports 17, 18 for each cylinder of an internal combustion engine. This preferred embodiment shows a four-valve type engine, but the number of valves is not restricted in particular as long as there are at least one suction valve and at least one exhaust valve.

Figure 1:
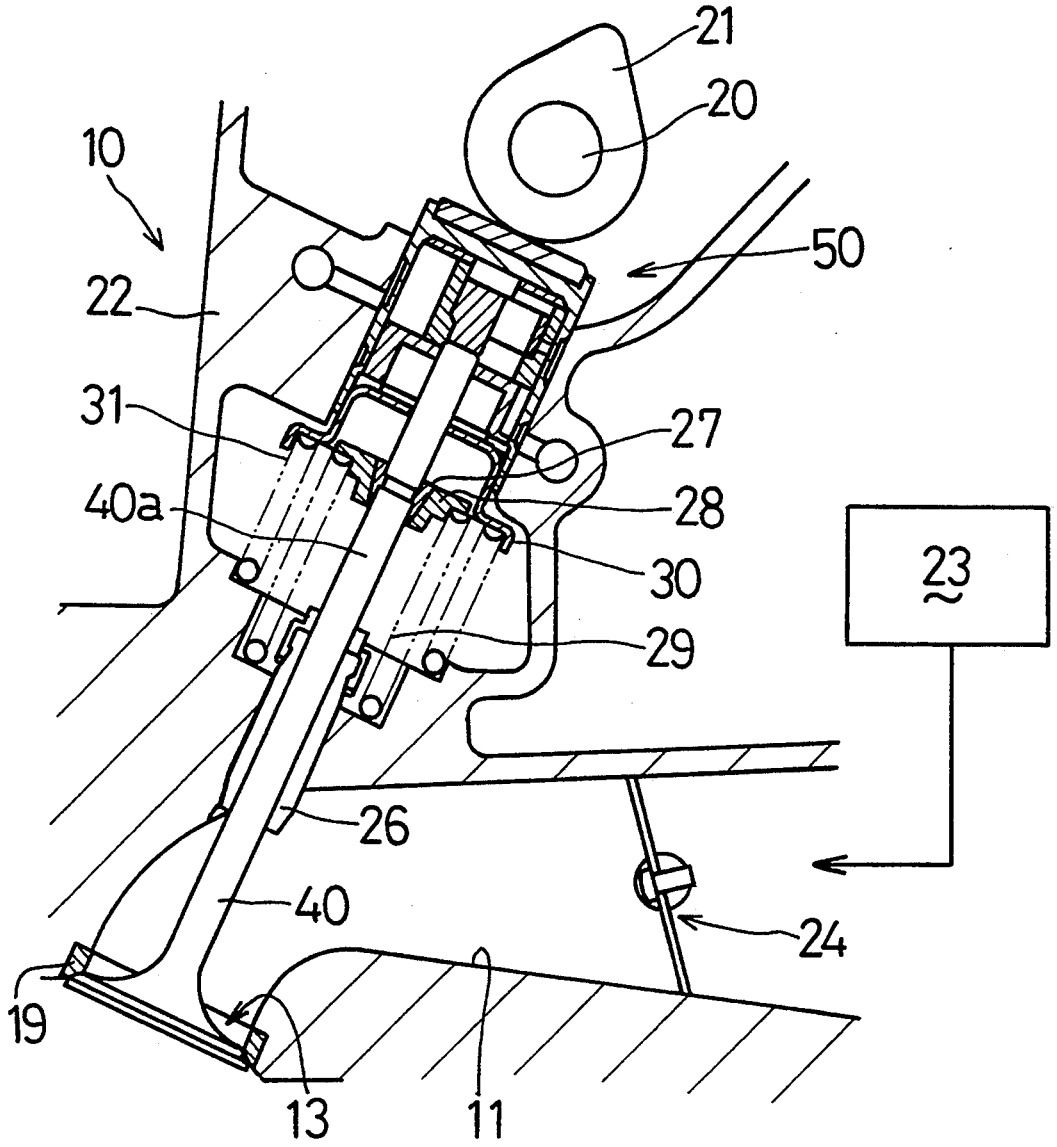
FIG. 1 is a diagrammic view of a valve control device of an engine according to the preferred embodiment of the present invention.

A valve control device 10 for an engine shown in FIG. 1 is generally referred to as a direct type valve control device, and the driving force of a cam 21, which is fixed on a cam shaft 20, is transmitted to a suction valve 40 only via a lifter 50, and not through a rocker arm not shown. The lifter 50 has an adjustable mechanism. The lifter 50 having an adjustable mechanism has to be employed only for the suction (intake) valve 40 which opens and closes the suction port 13. In this case, since a mixed gas is supplied only to the suction passage 11, the mixed gas can be supplied to a cylinder with swirls. Further, the lifter 50 may be provided to an exhaust valve not shown which opens and closes an exhaust port.

Furthermore, if each lifter of all suction and exhaust valves of one cylinder has an adjustable mechanism, an adjustable cylinder engine can be installed.

The lifter 50 has the same construction even when employed for any valve of the suction and exhaust valves. Accordingly, in FIG. 1, the valve control device 10 of the preferred embodiment is described to be provided for the suction valve 40 which opens and closes the suction port 13. A cylinder head 22 for an engine not shown has the suction passage 11 and rotatably and detachably holds the cam shaft 20. One suction valve 40 is engaged with one lifter 50, and one lifter 50 is engaged with one cam 21. The suction passage 11 is sharply bent around a portion where the suction valve 40 is arranged. In the upper stream of the suction passage 11, a fuel supply means 23 such as a carburetor and an injector is arranged. Further, a stop valve 24 is arranged between the fuel supply means 23 and the suction valve 40 in the suction passage 11. The operation of the stop valve 24 is controlled by a control unit 94 shown in FIG. 6 (described later). It is preferable that the stop valve 24 is arranged in the upper stream of the sharply bent portion of the suction passage 11. A valve stem **40*a* of the suction valve 40 is guided by a guide member 26 which is fixed on the cylinder head 22. A retainer 28 is fixed on the top of the valve stem 40*a* via a cotter 27. Between the retainer 28 and a supporting portion of the cylinder head 22, a valve spring 29 is disposed. A retainer 30 is engaged on the bottom of the lifter 50. Between the retainer 30 and the supporting portion of the cylinder head 22, a spring 31 is disposed. 19** designates a valve seat.

Now, the lifter 50 will be described with reference to FIGS. 3 to 5 and 7. A cup-shaped body 51 is slidably arranged in a bore 25 formed in a cylinder head 22, and a first pad 52 is fixed on the contact surface of the body 51 with the cam 21. A cylinder 54 is fixed so as not to be slipped off from an inner space 53 of the body 51 by a plate 55 and a C-shaped ring 56. The top surface of the cylinder 54 is in contact with the reverse surface of the top of the body 51. Inside the cylinder 54, a sliding passage 57 is formed in a direction perpendicular to the axial direction of the suction valve 40. A spool 58 is arranged in the sliding passage 57 so as to permit horizontal transfer. Further, in a bore 64 of the spool 58, a slider 61 having a driving force transmitting portion 59 and a cavity portion 60 is arranged. The slider 61 is disposed in the bore 64 of the spool 58 in such a manner that it is slightly movable in the upward and downward directions. A stepped portion 65 functions as a stopper of the slider 61 in a downward direction. The upper portion of a second pad 62 is inserted into a hole 63 of the cylinder 54, and the fore end of the second pad 62 is in contact with the reverse surface of the top of the body 51 . In the meanwhile, the lower portion of the second pad 62 is positioned in the bore 64 of the spool 58 and contacts the upper surface of the slider 61. The cylinder 54 has a slit 66, and a spring 67 arranged in the slit 66 urges the spool 58 to a first position (the position shown in FIG. 3) in the sliding passage 57. 68 in FIG. 4 designates a pin for preventing the cylinder 54 from rotating. A bore 69 is formed in the cylinder 54 so as to allow the fore end of the valve stem **40*a* of the suction valve 40 to enter the bore 64 of the spool 58. When the spool 58 is held at the first position shown in FIG. 3, the fore end of the valve stem 40*a* is positioned in the cavity portion 60 of the slider 61. On the other hand, when the spool 58 is held at the second position shown in FIG. 7, the fore end of the valve stem 40*a* is in contact with the bottom surface of the driving force transmitting portion 59 of the slider 61. It must be noted that, when the lifter 50 contacts the cam 21 by a base circle as shown in FIG. 7, there is a slight clearance between the bottom surface of the driving force transmitting portion 59 and the fore end of the valve stem 40*a***.

Figure 3:
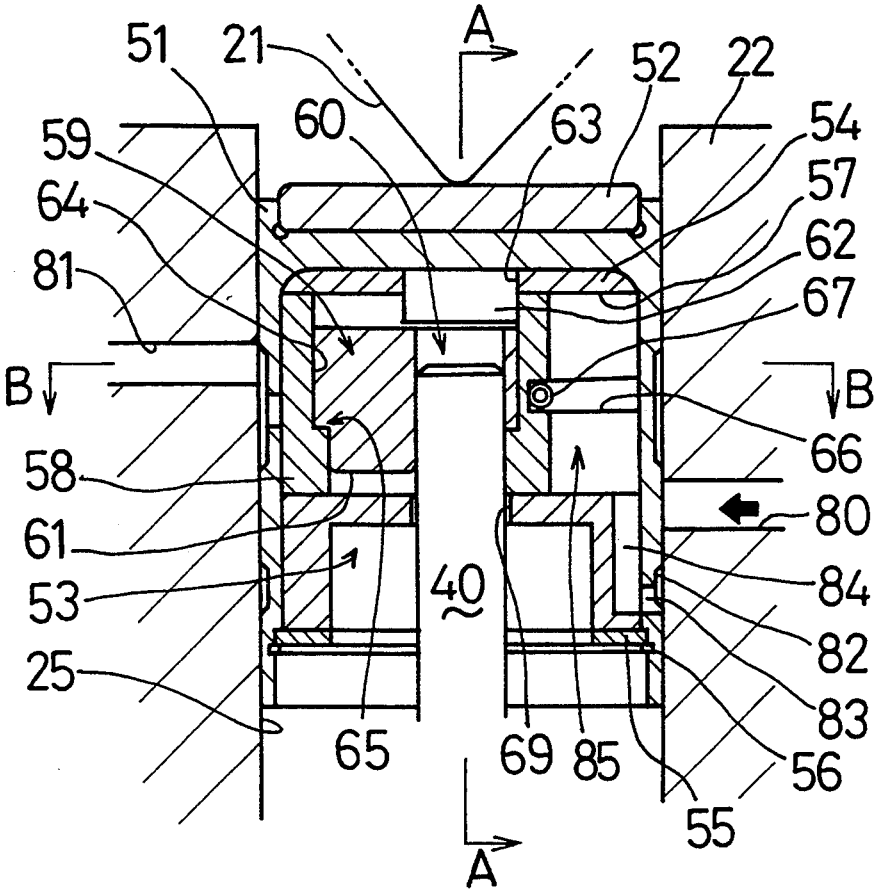
FIG. 3 is a first cross sectional view of a lifter according the preferred embodiment shown in FIG. 1.
Figure 4:
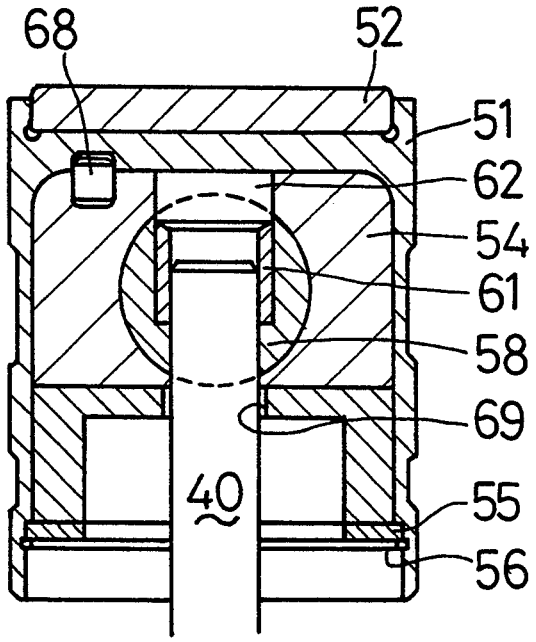
FIG. 4 is a cross sectional view of the lifter, taken along line A—A in FIG. 3.
Figure 5:
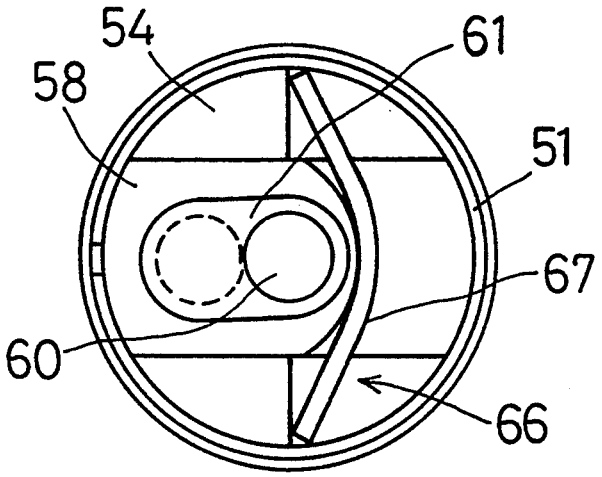
FIG. 5 is a cross sectional view of the lifter, taken along line B—B in FIG. 3.

A first hydraulic passage 80 and a second hydraulic passage 81 are formed in the cylinder head 22. One end of the first hydraulic passage 80 communicates with a first oil chamber 85 formed on the right side of the spool 58 in the sliding passage 57, via an annular groove 82 formed on the outer periphery of the body 51, a passage 83 connecting the annular groove 82 and the inner periphery of the body 51, and a passage formed in the cylinder 54. The annular groove 82 can communicate with one end of the first hydraulic passage 80 when the lifter 50 contacts the cam 21 by the base circle. However, when the lift amount of the cam 21 is large as shown in FIG. 3, the annular groove 82 cannot communicate with the one end of the first hydraulic passage 80 because the lifter 50 is highly depressed in the bore 25 of the cylinder head 22.

Figure 7:
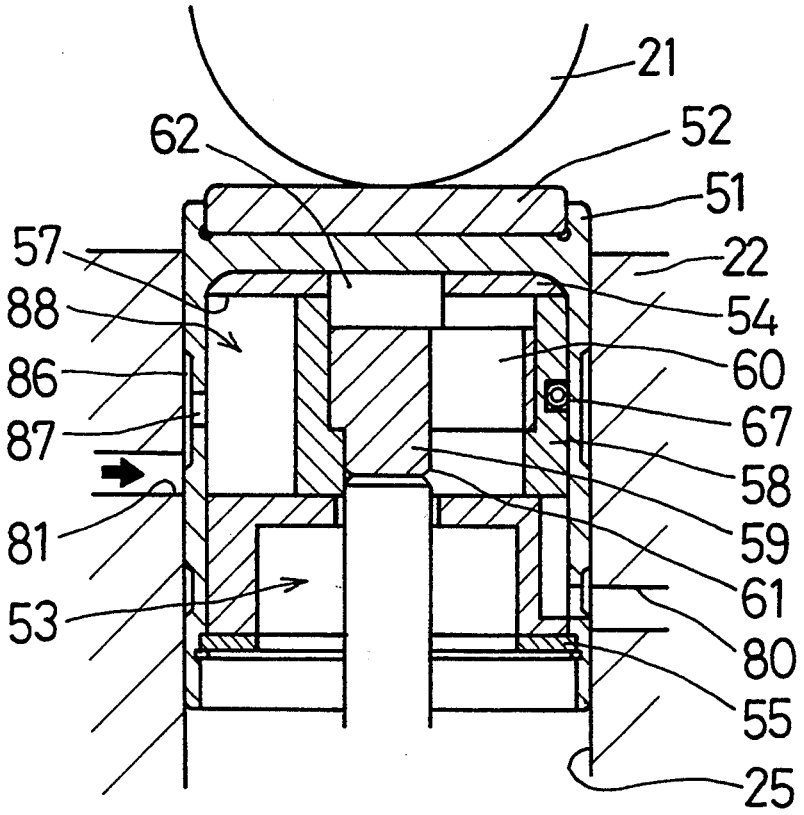
FIG. 7 is a second cross sectional view of the lifter of the preferred embodiment shown in FIG. 1.

As shown in FIG. 7, one end of the second hydraulic passage 81 communicates with a second oil chamber 88 formed on the left side of the spool 58 of the sliding passage 57, via an annular groove 86 formed on the outer periphery of the body 51, and a passage 87 connecting the annular groove 86 and the inner periphery of the body 51.

Figure 6:
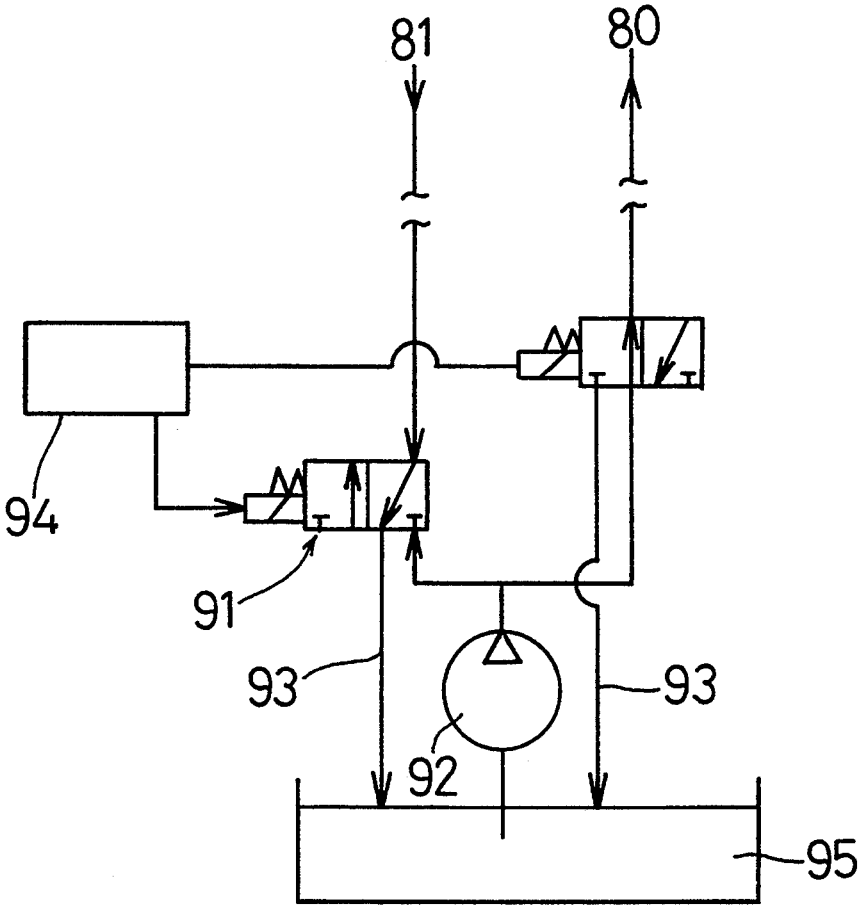
FIG. 6 is a first hydraulic schematic flow diagram of the valve control device of the preferred embodiment shown in FIG. 1.
Figure 8:
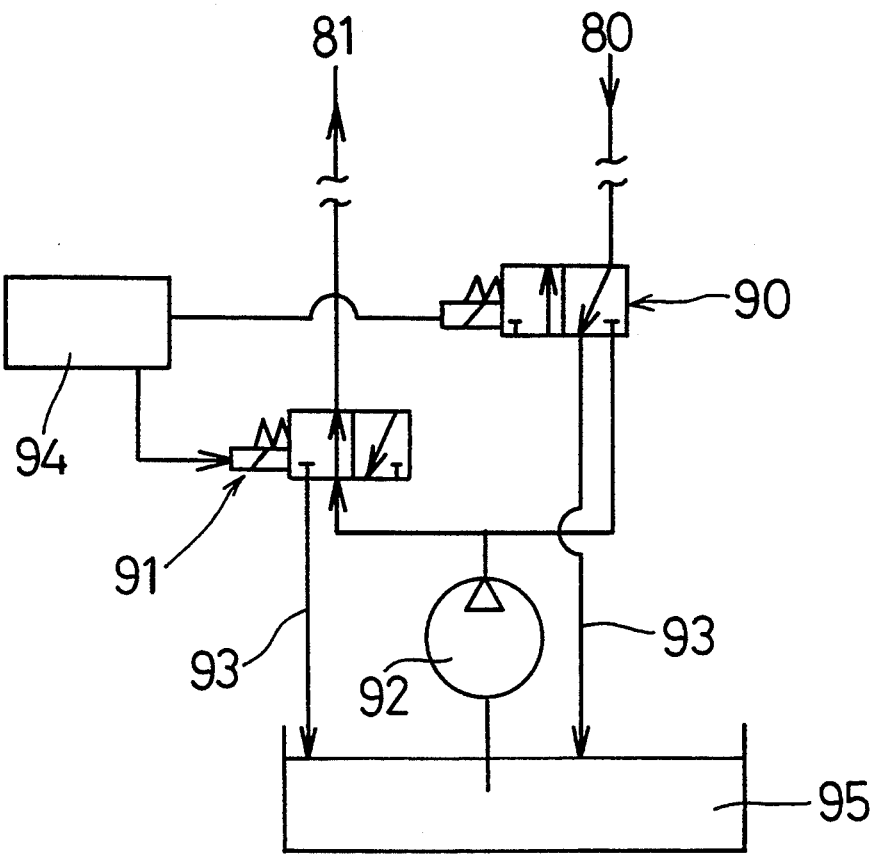
FIG. 8 is a second hydraulic schematic flow diagram of the valve control device of the preferred embodiment shown in FIG. 1.

As shown in FIGS. 6 and 8, each other end of the first hydraulic passage 80 and the second hydraulic passage 81 can alternatively communicate with either of a hydraulic pump 92 and a drain 93 via three way valves 90, 91. The operations of the three way valves 90, 91 are controlled by the control unit 94 of the engine. Further, the suction side of the hydraulic pump 92 and the drain 93 communicate with an oil pan 95 of the engine.

In the valve control device 10 having the above construction, when the engine is stopped, since the hydraulic pump 92 does not generate hydraulic pressure, no hydraulic pressure is applied to either of the first oil chamber 85 and the second oil chamber 88. Accordingly, the spool 58 is held at the first position shown in FIG. 3 by the urging force of the spring 67. When the engine is initiated, the hydraulic pump 92 starts to generate hydraulic pressure. The control unit 94 has various information such as the number of revolutions and loads of the engine. When the engine has a low rotational speed or a low load immediately after the initiation of the engine, the air amount to be required is small, and an efficient combustion by making swirls in the cylinders is requested. Accordingly, the control unit 94 stops the function of the suction passage 11 of the two suction passages 11, 12. Namely, as shown in FIG. 6, the control unit 94 controls the three way valves 90, 91 so that the hydraulic pressure discharged from the hydraulic pump 92 is applied only to the first hydraulic passage 80 via the three way valve 90 and the second hydraulic passage 81 communicates with the drain 93 via the three way valve 90. As a result, the hydraulic pressure from the hydraulic pump 92 is applied only to the first oil chamber 85. Thus, the first oil chamber 85 is filled with the hydraulic pressure and the spool 58 is kept at the first position. In the case where the spool 58 is held at the first position, even when the lifter 50 vertically reciprocates in the bore 25 of the cylinder head 22, the fore end of the valve stem 40*a* overlaps with the cavity portion 60 of the slider 61 and only goes in and out of the cavity portion 60. Therefore, the suction valve 40 remains to be pressed against the valve seat 19 by the urging force of the spring 29, and the suction port 13 is not opened. Simultaneously, the control unit 94 closes the suction passage 11 by the stop valve 24. In this case, the mixed gas is supplied to both of the suction passages 11, 12 by the fuel supply means 23, but, because the stop valve 24 closes the suction passage 11, the fuel components of the mixed gas are not collected at the bent portion of the suction passage 11 near the suction port 13. Further, a lifter for an exhaust valve which acts on either of the exhaust ports 17, 18 may have the same function in order to stop the actuation of the exhaust valve.

On the other hand, when the engine has a high rotational speed or a high load, since the air amount to be required by the engine increases, both the suction passages 11, 12 must function properly. Therefore, as shown in FIG. 8, the control unit 94 controls the three way valves 90, 91 so that the hydraulic pressure discharged from the hydraulic pump 92 is applied only to the second hydraulic passage 81 via the three way valve 91 and the first hydraulic passage 80 communicates with the drain 93 via the three way valve 90. As a result, the hydraulic pressure is applied only to the second oil chamber 88. Thus, the second oil chamber 88 is filled with the hydraulic pressure, and the spool 58 is transferred to the second position against the urging force of the spring 67. When the spool 58 is held at the second position, since the fore end of the valve stem 40*a* contacts the bottom surface of the driving force transmitting portion 59 of the slider 61, the lifter 50 enters the bore 25 of the cylinder head 22 according to the increase in the lift amount of the cam 21, and the driving force of the cam 21 is transmitted to the valve stem 40*a* via the first pad 52, the body 51, the second pad 62, and the driving force transmitting portion 59. Therefore, the suction valve 40 lifts off the valve seat 19 against the urging force of the spring 29. With the decrease in the lift amount of the cam 21, the suction valve 40 again rests on the valve seat 19 by the urging force of the spring 29.

When the engine has a low rotational speed or a low load again, the control unit 94 controls the three way valves 90, 91 as shown in FIG. 6 in order to transfer the slider from the second position to the first position. Because the first hydraulic passage 80 can communicate with the annular groove 82 only when the cam 21 contacts the lifter 50 by the base circle, the fore end of the valve stem 40*a* is never engaged with the slider 61 when the slider 61 is transferred from the second position to the first position. Thus, the valve change-over operation is safely executed.

Figure 9:
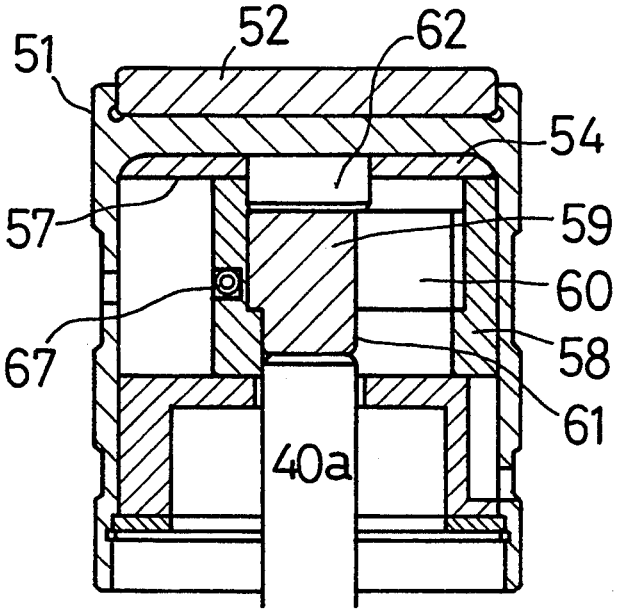
FIG. 9 is a cross sectional view of the lifter of the other preferred embodiment.

FIG. 9 shows the other preferred embodiment which is different from the above preferred embodiment. In this embodiment, the slider 61 is held at the second position by the spring 67 when the engine is started. Namely, the valve stem 40 is engaged with the slider 61. As a result, the valve stem 40 is driven by a high-speed cam via the slider 61.

Obviously, many modifications and variations of the present invention are possible in the light of the above teachings. It is therefore to be understood that within the scope of the appended claims, the invention may be practiced otherwise than as specifically described.

What is claimed is:

1. A valve control device for an engine, having a fuel supply means arranged in an intake passage, a valve arranged in at least one of the intake and an exhaust passage, and a cam for driving said valve via a lifter, said lifter comprising:

a body which slidably moves in a bore formed in a cylinder head of said engine;

a cylinder arranged in said body and forming a sliding passage in a direction perpendicular to an axial direction of said valve;

a spool which is transferred between a first position and a second position in said sliding passage by hydraulic pressure;

a slider arranged in said spool and having a driving force transmitting portion and a cavity portion; and a spring which holds said spool at the first position, the driving force of said cam being transmitted to said valve via said body and said driving force transmitting portion of said slider, and a stop valve being arranged between said fuel supply means and said valve in said intake passage in order to close said intake passage when said spool is held at the first position.

* * * * *